US011677137B2

(12) United States Patent
Lo et al.

(10) Patent No.: US 11,677,137 B2
(45) Date of Patent: Jun. 13, 2023

(54) ELECTRONIC DEVICE

(71) Applicant: Quanta Computer Inc., Taoyuan (TW)

(72) Inventors: Wen-Yuan Lo, Taoyuan (TW); Jui-Chun Jao, Taoyuan (TW); Chen-An Lu, Taoyuan (TW); Yao-Sheng Chang, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 0 days.

(21) Appl. No.: 17/676,354

(22) Filed: Feb. 21, 2022

(65) Prior Publication Data

US 2023/0082822 A1 Mar. 16, 2023

(30) Foreign Application Priority Data

Sep. 13, 2021 (TW) ..... 110133950

(51) Int. Cl.
*H01Q 1/24* (2006.01)
*H01Q 13/10* (2006.01)
*H01Q 1/38* (2006.01)

(52) U.S. Cl.
CPC ..... *H01Q 1/243* (2013.01); *H01Q 1/38* (2013.01); *H01Q 13/106* (2013.01)

(58) Field of Classification Search
CPC ..... H01Q 1/24; H01Q 1/38; H01Q 13/106
See application file for complete search history.

(56) References Cited

U.S. PATENT DOCUMENTS 10,542,130 B1 * 1/2020 Lo ..... H04M 1/026

FOREIGN PATENT DOCUMENTS

TW I688159 B 3/2020

OTHER PUBLICATIONS

Chinese language office action dated Aug. 15, 2022, issued in application No. TW 110133950.

* cited by examiner

*Primary Examiner* — Andrea Lindgren Baltzell
(74) *Attorney, Agent, or Firm* — McClure, Qualey & Rodack, LLP

(57) ABSTRACT

An electronic device is provided, including a housing, a first slot, a second slot, and a circuit board. The first and second slots are formed on the housing and spaced apart from each other. The circuit board is disposed in the housing and includes a first antenna structure and a second antenna structure. The first antenna structure has a Z-shaped conductive body, and the second antenna structure includes a microstrip portion and a base portion. The base portion is electrically connected to the conductive body, and the microstrip portion is spaced apart from the base portion.

10 Claims, 5 Drawing Sheets

ELECTRONIC DEVICE

CROSS REFERENCE TO RELATED APPLICATIONS

This Application claims priority of Taiwan Patent Application No. 110133950, filed on Sep. 13, 2021, the entirety of which is incorporated by reference herein.

BACKGROUND OF THE INVENTION

Field of the Invention

The present invention relates to an electronic device, and, in particular, to an electronic device capable of wireless communication.

Description of the Related Art

As computer and wireless communication technologies have progressed, conventional laptop computers and tablet computers are now usually provided with antenna structures. However, to meet the requirements for 2.4 GHz/5 GHz/6 GHz wireless signal communication and improve the performance of the antennas, there is a need to redesign the antenna structures in conventional electronic devices (e.g. laptop computers and tablet computers).

BRIEF SUMMARY OF THE INVENTION

An object of the present invention is to provide an electronic device that includes a metal housing, a first slot, a second slot, and a rectangular circuit board. The first and second slots are formed on the housing and spaced a distance apart from each other. The rectangular circuit board is disposed in the housing and has a first antenna structure and a second antenna structure. The first antenna structure has a Z-shaped conductive body, and the second antenna structure has a microstrip portion and a rectangular base portion.

The base portion is electrically connected to the conductive body, and the microstrip portion is spaced apart from the base portion. When viewed in a vertical direction perpendicular to the circuit board, the first slot partially overlaps the conductive body, and the second slot partially overlaps the base body.

In some embodiments, the conductive body has a first conductive portion, a second conductive portion, a third conductive portion, and a fourth conductive portion, wherein the first and third conductive portions have a longitudinal structure extending along the long axis of the circuit board, the second conductive portion connects to the first and third conductive portions, and the fourth conductive portion has an L-shaped structure that connects to the third conductive portion.

In some embodiments, when viewed in the vertical direction, the second, third, and fourth conductive portions partially overlap the first slot.

In some embodiments, the second conductive portion has a feed point.

In some embodiments, the base portion has a ground point.

In some embodiments, the second conductive portion and the base portion are spaced 1 mm apart from each other.

In some embodiments, the distance is greater than or equal to 3 mm.

In some embodiments, the base portion is longer than the microstrip portion in a direction parallel to the long axis of the circuit board.

In some embodiments, when viewed in the vertical direction, the microstrip portion does not overlap the first slot.

In some embodiments, when viewed in the vertical direction, the microstrip portion does not overlap the second slot.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The making and using of the embodiments of the electronic device are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood by one of ordinary skill in the art to which this invention belongs. It should be appreciated that each term, which is defined in a commonly used dictionary, should be interpreted as having a meaning conforming to the relative skills and the background or the context of the present disclosure, and should not be interpreted in an idealized or overly formal manner unless defined otherwise.

In the following detailed description of the preferred embodiments, reference is made to the accompanying drawings, and in which specific embodiments of which the invention may be practiced are shown by way of illustration. In this regard, directional terminology, such as "top," "bottom," "left," "right," "front," "back," etc., is used with reference to the orientation of the figures being described. The components of the present invention can be positioned in a number of different orientations. As such, the directional terminology is used for the purposes of illustration and is in no way limiting.

Figure 1:
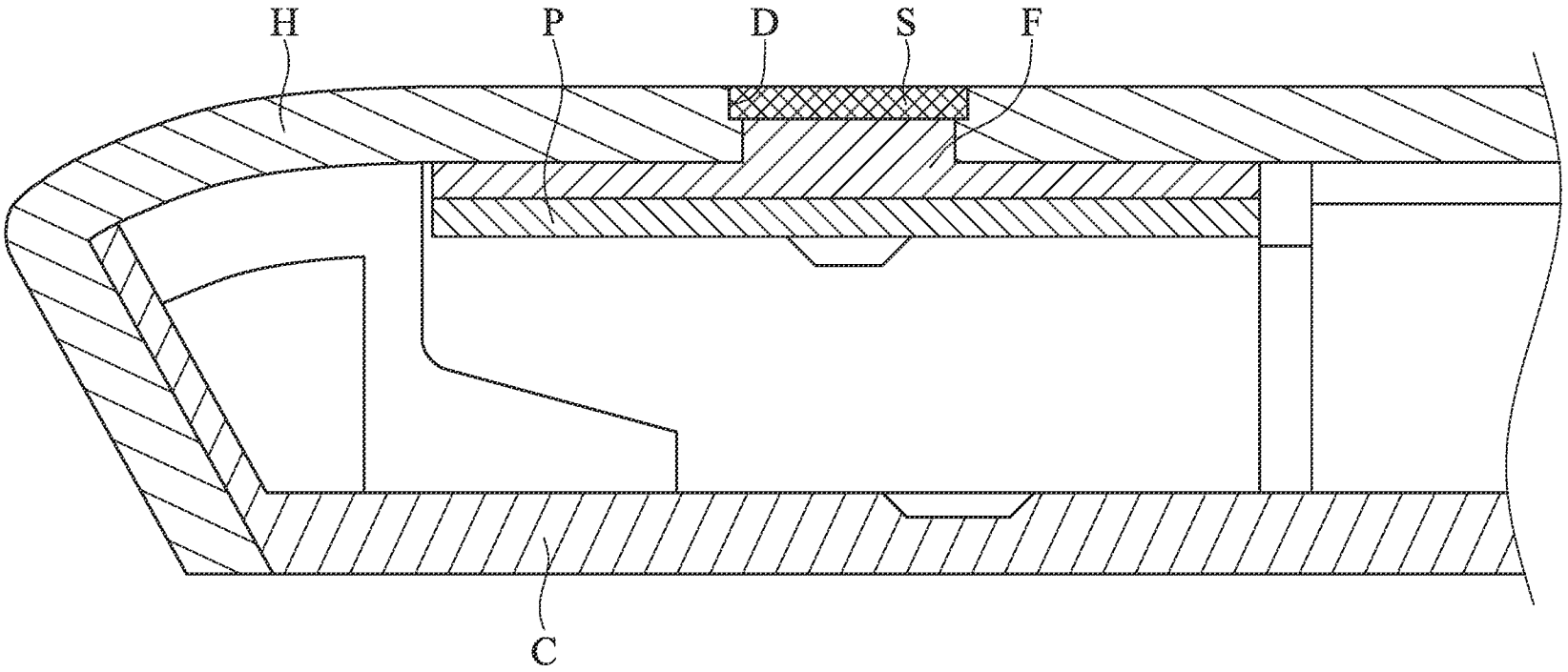
FIG. 1 is a partial cross-sectional view of an electronic device in accordance with an embodiment of the invention.

FIG. 1 is a partial cross-sectional view of an electronic device in accordance with an embodiment of the invention. As shown in FIG. 1, the electronic device may be a laptop computer or tablet computer that has a housing H and a bottom cover C connected to each other. In this embodiment, the housing H and the bottom cover C have metal material, and a hollow pattern D is formed on the top surface of the housing H.

Still referring to FIG. 1, a space is defined between the housing H and the bottom cover C. A circuit board P is accommodated in the space and adhered to the inner surface of the housing by the adhesive F. Moreover, a decorative board S is embedded in the hollow pattern D of the housing H to preserve the integral appearance of the electronic device. It should be noted that the metal housing H and the circuit board P can be coupled with each other as an RF antenna via the hollow pattern D.

Figure 2:
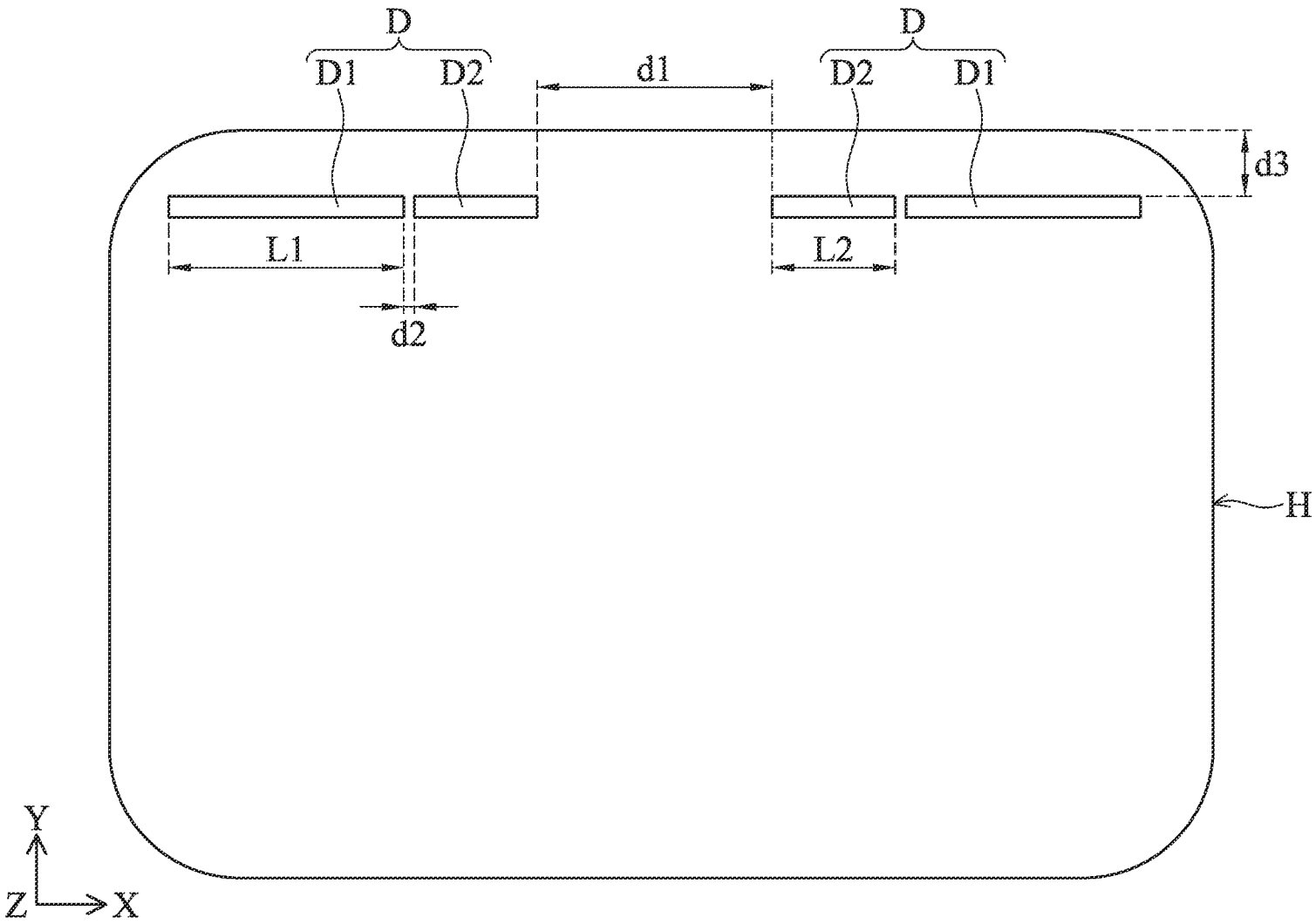
FIG. 2 is a top view of the housing H in FIG. 1.

FIG. 2 is a top view of the housing H in FIG. 1. As shown in FIG. 2, the housing H (e.g. a metal housing of a laptop computer or tablet computer) has a substantially rectangular structure, wherein two symmetrical slot patterns D are formed on the housing H and arranged along the X axis. Each of the slot patterns D has a first slot D1 and a second slot D2, wherein the two second slots D2 are located between the two first slots Dl.

In some embodiments, the two first slots D1 may be arranged between the two second slots D2 along the X axis, not limited to the embodiments of invention.

As mentioned above, the metal housing H and the circuit board P can be coupled with each other via the hollow patterns D, and they can be used as an RF antenna for transmitting/receiving RF signal.

Still referring to FIG. 2, the two hollow patterns D are spaced apart from each other by a first interval d1, and the first and second slots D1 and D2 of each hollow pattern D are spaced apart from each other by a second interval d2. Moreover, the first and second slots D1 and D2 of the hollow patterns D are spaced apart from an edge of the housing H by a third interval d3, wherein the edge is parallel to the long axis (X axis) of the rectangular housing H.

In some embodiments, the first interval d1 is equal to or greater than 60 mm, the second interval d2 is equal to or greater than 3 mm, and the third interval d3 is equal to or greater than 10 mm.

In some embodiments, the first slot D1 has a first length L1 along the X axis, and the second slot D2 has a second length L2 along the X axis, wherein the first length L1 is about 30 mm, and the second length L2 is about 17 mm.

Figure 3:
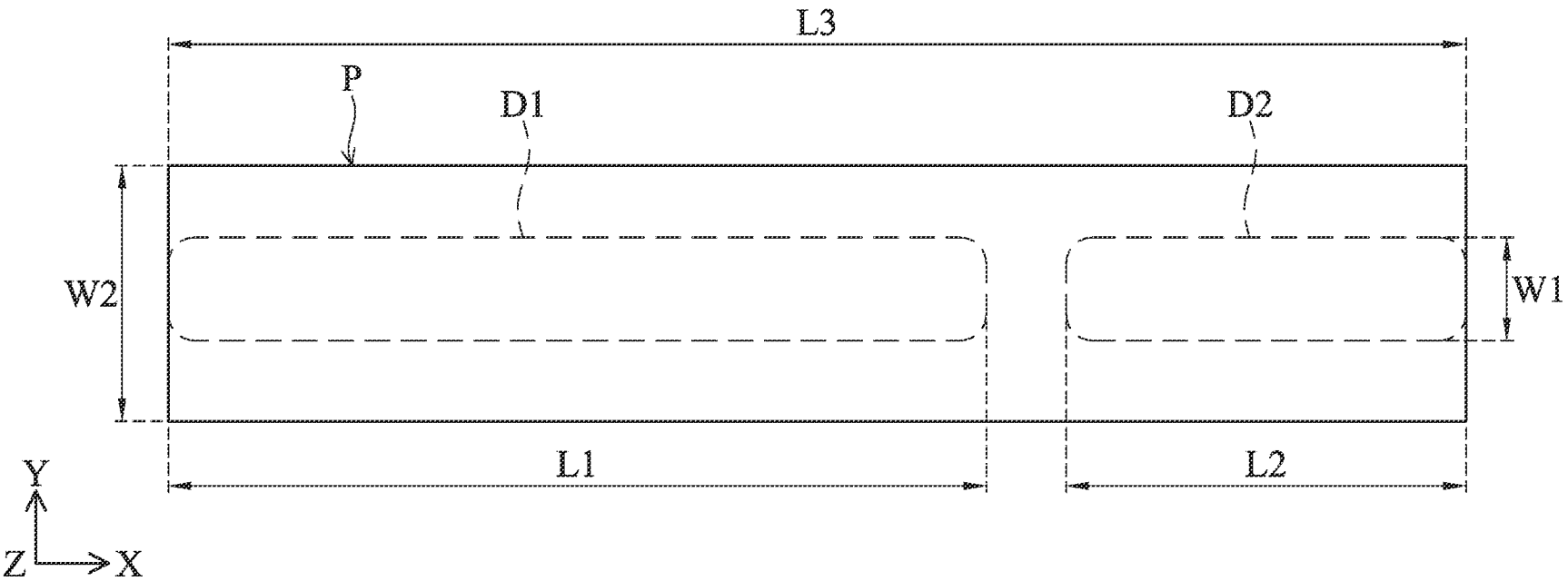
FIG. 3 is a top view showing relative position of the circuit board P in the housing H and the first and second slots D1 and D2 at the left of the housing H.

FIG. 3 is a top view showing relative position of the circuit board P in the housing H and the first and second slots D1 and D2 at the left of the housing H. In this embodiment, the circuit board P is disposed in the housing H of the electronic device and located below the first and second slots D1 and D2 of the hollow pattern D. Specifically, the first and second slots D1 and D2 at least partially overlap the circuit board P when viewed along the Z axis (vertical direction). Here, the circuit board P has a third length L3 along the X axis, wherein the third length L3 is about 50 mm.

Still referring to FIG. 3, the first and second slots D1 and D2 have a first width W1 along the Y axis, and the circuit board P has a second width W2 along the Y axis, wherein the first and second slots D1 and D2 are located in the middle of the circuit board P along the Y axis, wherein W2>W1.

In some embodiments, the first width W1 is about 1.6 mm, and the second width W2 is about 8 mm.

Figure 4:
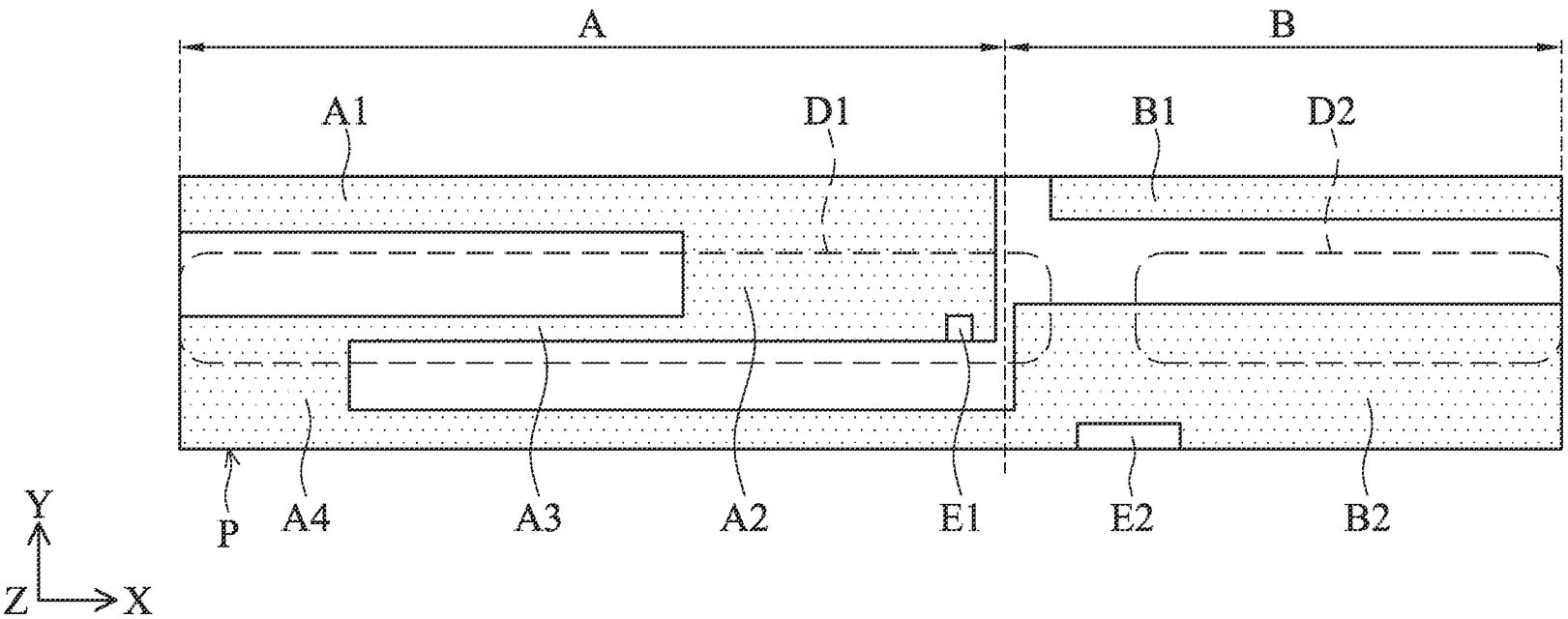
FIG. 4 is a top view of the circuit board P of FIG. 3 that includes a first antenna structure A and a second antenna structure B.

FIG. 4 is a top view of the circuit board P of FIG. 3 that includes a first antenna structure A and a second antenna structure B. As shown in FIG. 4, the circuit board P may be a printed circuit board that includes a first antenna structure A and a second antenna structure B connected to each other along the X axis.

The first antenna structure A has a Z-shaped conductive body that includes a first conductive portion A1, a second conductive portion A2, a third conductive portion A3, and a fourth conductive portion A4. In this embodiment, the first and third conductive portions A1 and A3 have a longitudinal structure extending along the long axis (X axis) of the circuit board P.

The second conductive portion A2 has a rectangular structure and connects to the first and third conductive portions A1 and A3. The fourth conductive portion A4 has an L-shaped structure and connects to the third conductive portion A3. It should be noted that the second conductive portion A2 has a feed point E1 for signal communication.

The second antenna structure B includes a microstrip portion B1 and a rectangular base portion B2. The microstrip portion B1 can be used as a microstrip resonator of the RF antenna, and the base portion B2 is connected to the fourth conductive portion A4 of the first antenna structure along the X axis. Here, the microstrip portion B1 and the base portion B2 are separated from each other, and the base portion B2 has a ground point E2 electrically connected to a wide copper foil for signal grounding.

Figure 5:
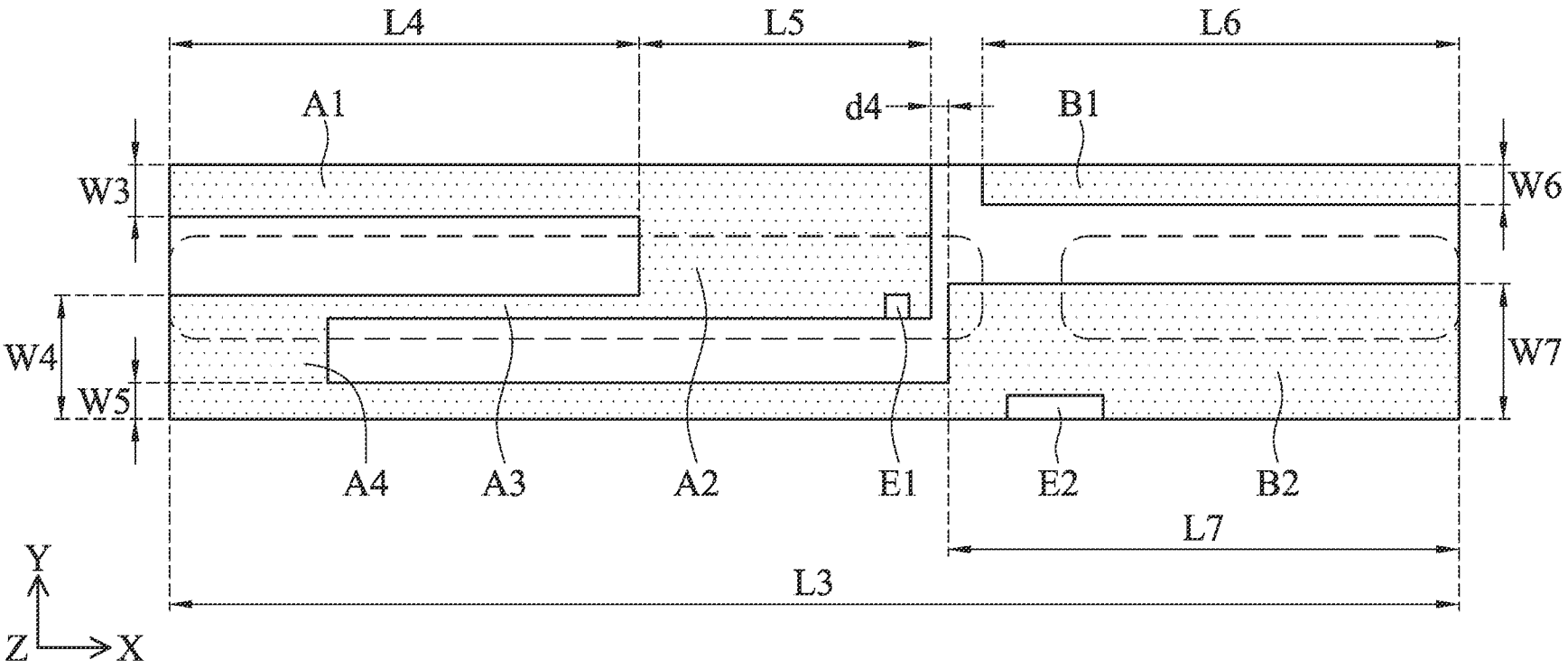
FIG. 5 is a scale diagram that shows the dimensions of each element on the circuit board P of FIG. 4.

FIG. 5 is a scale diagram that shows the dimensions of each element on the circuit board P of FIG. 4. Referring to FIG. 5, the first conductive portion A1 of the first antenna structure A has a fourth length L4 along the X axis, the second conductive portion A2 of the first antenna structure A has a fifth length L5 along the X axis, the microstrip portion B1 of the second antenna structure B has a sixth length L6 along the X axis, and the base portion B2 of the second antenna structure B has a seventh length L7 along the X axis. Additionally, the second conductive portion A2 of the first antenna structure A and the base portion B2 of the second antenna structure B are spaced apart from each other by a fourth interval d4 along the X axis.

In this embodiment, the fourth length L4 is about 20 mm, the fifth length L5 is about 7 mm, the sixth length L6 is about 20 mm, the seventh length L7 fourth is about 22 mm, and the interval d4 is about 1 mm. That is, the base portion B2 is longer than the microstrip portion B1 in a direction parallel to the long axis (X axis) of the circuit board P, and the second conductive portion A2 and the base portion B2 are spaced about lmm apart from each other along the X axis.

Still referring to FIG. 5, the first conductive portion A1 of the first antenna structure A has a third width W3 along the Y axis, the third and fourth conductive portions A3 and A4 of the first antenna structure A have a fourth width W4 along the Y axis, and the bottom of the fourth conductive portion A4 has a fifth width W5 along the Y axis.

In this embodiment, the third width W3 is about 3 mm, the fourth width W4 is about 3.4 mm, and the fifth width W5 is about 2 mm.

Furthermore, the microstrip portion B1 of the second antenna structure B has a sixth width W6 along the Y axis, and the base portion B2 of the second antenna structure B has a seventh width W7 along the Y axis, wherein the microstrip portion B1 and the base portion B2 are spaced apart from each other.

In this embodiment, the sixth width W6 is about 2.7 mm, and the seventh width W7 is about 4 mm.

It can be seen in FIG. 5 that when viewed in the vertical direction (Z axis), the second, third, and fourth conductive portions A2, A3, and A4 of the first antenna structure A and the base portion B2 of the second antenna structure B partially overlap the first slot D1. Additionally, the base portion B2 of the second antenna structure B partially overlaps the second slot D2 when viewed in the vertical direction (Z axis). However, the microstrip portion B1 does not overlap the first slot D1 or the second slot D2, and the vertical direction (Z axis) is perpendicular to the circuit substrate P.

In this configuration, the first slot D1 on the housing H can be coupled with the first, second, third, and fourth conductive portions A1, A2, A3, and A4 of the first antenna structure A and the microstrip portion B1 of the second antenna structure B in different ways as a multi-resonant antenna, thereby facilitating dual-band (2.4 GHz/5 GHz) wireless signal communication. Additionally, the microstrip portion B1 and the base portion B2 of the second antenna structure B can also be coupled with each other to provide resonance at 6 GHz, whereby triple band (2.4 GHz/5 GHz/6 GHz) wireless communication of the electronic device can be achieved.

In some embodiments, another circuit board P (as shown in FIGS. 4 and 5) can be disposed below the first and second slots D1 and D2 at the right of the housing H, whereby the housing H and the two circuit boards P can be arranged in a symmetrical configuration for triple band (2.4 GHz/5 GHz/6 GHz) wireless communication.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An electronic device, comprising:

a housing, comprising metal material;

a first slot, formed on the housing;

a second slot, formed on the housing, wherein the first and second slots are spaced a distance apart from each other; and a rectangular circuit board disposed in the housing, comprising a first antenna structure and a second antenna structure, wherein the first antenna structure has a Z-shaped conductive body, and the second antenna structure has a microstrip portion and a rectangular base portion;

wherein the base portion is electrically connected to the conductive body, and the microstrip portion is spaced apart from the base portion;

wherein when viewed in a vertical direction perpendicular to the circuit board, the first slot partially overlaps the conductive body, and the second slot partially overlaps the base body.

2. The electronic device as claimed in claim 1, wherein the conductive body has a first conductive portion, a second conductive portion, a third conductive portion, and a fourth conductive portion, wherein the first and third conductive portions have a longitudinal structure extending along a long axis of the circuit board, the second conductive portion connects to the first and third conductive portions, and the fourth conductive portion has an L-shaped structure that connects to the third conductive portion.

3. The electronic device as claimed in claim 2, wherein when viewed in the vertical direction, the second, third, and fourth conductive portions partially overlap the first slot.

4. The electronic device as claimed in claim 2, wherein the second conductive portion has a feed point.

5. The electronic device as claimed in claim 4, wherein the base portion has a ground point.

6. The electronic device as claimed in claim 2, wherein the second conductive portion and the base portion are spaced 1mm apart from each other.

7. The electronic device as claimed in claim 1, wherein the distance is greater than or equal to 3 mm.

8. The electronic device as claimed in claim 1, wherein the base portion is longer than the microstrip portion in a direction parallel to the long axis of the circuit board.

9. The electronic device as claimed in claim 1, wherein when viewed in the vertical direction, the microstrip portion does not overlap the first slot.

10. The electronic device as claimed in claim 1, wherein when viewed in the vertical direction, the microstrip portion does not overlap the second slot.

* * * * *